US006341837B1

(12) United States Patent
Jung

(10) Patent No.: US 6,341,837 B1
(45) Date of Patent: Jan. 29, 2002

(54) INK-JET PRINTER HAVING A WASTE INK COLLECTING BOX

(75) Inventor: Jong-Sung Jung, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 14 days.

(21) Appl. No.: 09/614,879

(22) Filed: Jul. 12, 2000

(30) Foreign Application Priority Data

Jul. 31, 1999 (KR) ..... 99-31550

(51) Int. Cl.[7] ..... B41J 2/175; B41J 2/18; B41J 2/185

(52) U.S. Cl. ..... 347/36

(58) Field of Search ..... 347/36, 89, 90

(56) References Cited

U.S. PATENT DOCUMENTS 4,524,365 A 6/1985 Kakeno et al.
4,901,094 A 2/1990 Iwagami et al.
4,965,596 A 10/1990 Nagoshi et al.
5,221,935 A 6/1993 Uzita
5,329,306 A 7/1994 Carlotta
5,801,725 A 9/1998 Neese et al.
5,946,009 A 8/1999 Youn
5,953,026 A 9/1999 Yoshino

*Primary Examiner*—Huan Tran
(74) *Attorney, Agent, or Firm*—Robert E. Bushnell, Esq.

(57) ABSTRACT

An ink-jet printer has a frame, a carriage, a waste ink collecting box and waste ink spreading device. The paper feeder is mounted to one side of the frame, while a discharge device is mounted to the other side of the frame. The carriage is provided with at least one ink cartridge and is transversely reciprocated between a printing area and a service area along a guide rod that is horizontally mounted to the frame. The waste ink collecting box is for collecting waste ink discharged from the ink cartridge in the service area. The waste ink spreading device uniformly spreads the waste ink heaped in the waste ink collecting box. The waste ink spreading device may have a waste ink spreader. The waste ink spreader may have a hinge portion rotatably mounted to the waste ink collecting box, a spreader arm extended from one side of the hinge portion, the spreader arm spreading heaped waste ink uniformly in the waste ink collecting box, and a spreader head extended from the opposite end of the hinge portion, the spreader head being actuated for rotation of the spreader arm.

31 Claims, 5 Drawing Sheets

INK-JET PRINTER HAVING A WASTE INK COLLECTING BOX

CLAIM OF PRIORITY

This application makes reference to, incorporates the same herein, and claims all benefits accruing under 35 U.S.C. §119 from an application entitled A Waste Ink Collection Box for Ink Jet Printer earlier filed in the Korean Industrial Property Office on Jul. 31, 1999, and there duly assigned Serial No. 99-31550 by that Office.

BACKGROUND OF THE INVENTION

1. Field of the Invention

The present invention relates in general to ink-jet printers, and more particularly, to an ink-jet printer that is capable of uniformly spreading waste ink, which is discharged from its ink cartridge, in its waste ink collecting box.

2. Description of the Related Art

In general, an ink-jet printer is a nonimpact printer that forms images by having jets of ink broken up into electrostatically charged drops. According to the input data, the electrostatically charged drops are guided into positions that form images and characters on a paper or other printable medium. As a print head moves across the surface of the paper, it shoots a stream of tiny, electrostatically charged ink drops from an ink cartridge at the page to form the image. A container within the ink-jet printer collects waste ink that is discharged just before a printing process. The hardened ink on the nozzles of the ink cartridge is removed and deposited in the waste ink container.

The collection of ink is not, however, always uniform. The nozzles come in contact with the ink from the waste ink container because the ink, especially black ink, accumulates towards the nozzle in the waste ink container. Inks such as black ink pile up in the waste ink container because it dries into a gel state. The nozzles becomes contaminated or even clogged by the waste ink. The quality of the print is greatly reduced because of the accumulation of the ink in the waste ink container.

The exemplar art of U.S. Pat. No. 5,801,725 for Slidable Wiping and Capping Service Station for-Ink Jet Printer issued to Neese, et al., U.S. Pat. No. 5,946,009 for Service Station for Ink-jet Printer issued to Youn, U.S. Pat. No. 4,524,365 for Receptacle for Waste Ink Collection in Ink Jet Recording Apparatus issued to Kakeno, et al., U.S. Pat. No. 4,901,094 for Waste Collecting Device of an Ink Jet Printer issued to Iwagami, et al., U.S. Pat. No. 5,221,935 for Waste Ink Receiving Cartridge and Ink Recording Apparatus Using said Cartridge issued to Uzita, U.S. Pat. No. 5,953,026 for Ink Jet Printing Apparatus, Method of Disposing Waste Liquids and Apparatus Therefor issued to Yoshino, U.S. Pat. No. 4,965,596 for Ink Jet Recording Apparatus with Waste Ink Distribution Paths to Plural Cartridges issued to Nagoshi, et al., and U.S. Pat. No. 5,329,306 for Waste Ink Separator for Ink Jet Printer Maintenance System issued to Carlotta disclose waste ink separators in ink-jet printers. I have found that the art does not show an efficient method and apparatus that uniformly spreads ink in a waste ink collecting box of an ink-jet printer.

SUMMARY OF THE INVENTION

Accordingly, the present invention has been made keeping in mind the above problems occurring in the prior art, and an object of the present invention is to provide to an ink-jet printer that is capable of uniformly spreading waste ink, which is discharged from an ink cartridge, in a waste ink collecting box.

It is another object to improve the servicing of the print head without reducing printing efficiency.

It is still another object to prevent the print head from being contaminated or clogged.

It is yet another object to increase the print quality of an ink-jet printer.

It is another object to increase the life span of an ink-jet cartridge.

In order to accomplish the above object, the present invention provides an ink-jet printer, having a frame, a paper feeder is mounted on one side and on the other side a discharge device is mounted; a carriage that has at least one ink cartridge loaded, the carriage being transversely reciprocated between a printing area and a service area along a guide rod that is horizontally mounted to the frame; a waste ink collecting box for collecting waste ink discharged from the ink cartridge in the service area; and a device for uniformly spreading the waste ink heaped in the waste ink collecting box.

Preferably, the waste ink spreading device may have a waste ink spreader, the waste ink spreader having a hinge portion rotatably mounted to the waste ink collecting box, a spreader arm extended from one side of the hinge portion, the spreader arm spreading heaped waste ink uniformly in the waste ink collecting box, and a spreader head extended from the opposite end of the hinge portion, the spreader head being actuated for rotation of the spreader arm.

Preferably, the waste ink spreading device may further comprise a spring that is secured to the waste ink collecting box and the spreader head of the waste ink spreader at both its ends. Preferably, the spreader head may be actuated by movement of the carriage. In particular, the waste ink spreading device may further have a pusher that is projected from the service area side of the carriage, the pusher actuating the spreader head to rotate the waste ink spreader.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
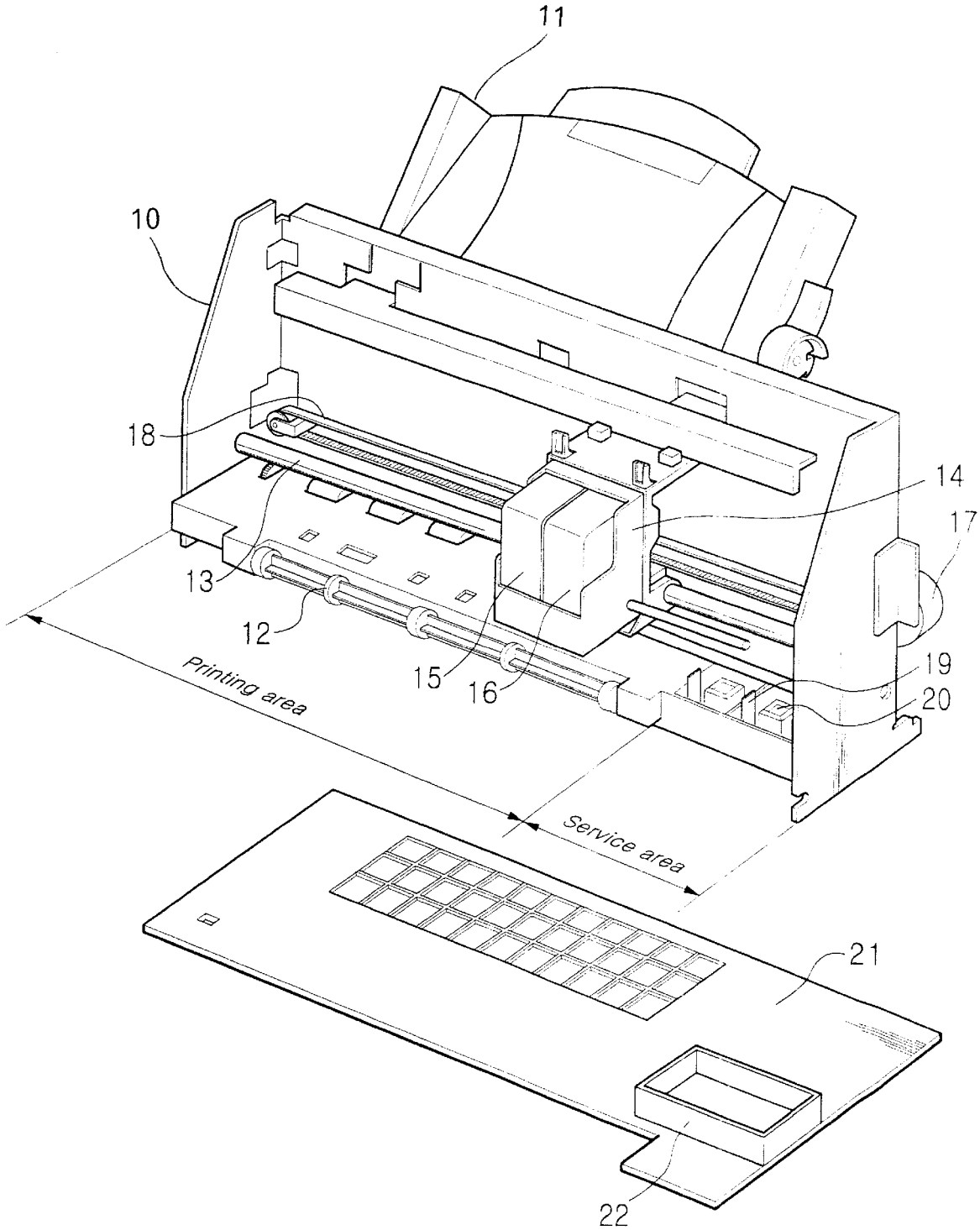
FIG. 1 is a perspective view of an ink-jet printer.

Turning now to the drawings, referring to FIG. 1, an ink-jet printer has a frame 10. A lower plate 21 is secured to the bottom of the frame 10. A paper feeder 11 is mounted to the rear portion of the frame 10, and a discharge roller 12 is mounted to the front portion of the frame 10. A printing unit is mounted in the frame 10. The printing unit has a guide rod 13 that is horizontally positioned, a carriage 14 that is slidably fitted around the guide rod 13, and a color ink cartridge 15 and a black ink cartridge 16 that are loaded on the carriage 14.

A driving device is provided so as to forcibly move the carriage 14 transversely. The driving device has a driving motor 17 that is mounted to one side of the rear portion of the frame 10 and a drive belt 18 that is driven by the drive motor 17 and securely connected to the rear portion of the carriage 14.

The interior area of the frame 10 may be divided into a printing area in which the carriage 14 is moved transversely while actual printing is performed and a service area in which the carriage 14 is retreated while actual printing is not performed. In particular, wipers 19 and sealing caps 20 are mounted in the service area of the frame 10. The wipers 19 serve to remove remaining ink and dirt that adhere to the nozzles of the ink cartridges 15 and 16 and the sealing caps 20 serve to enclose the nozzles of the ink cartridges 15 and 16 and prevent ink from being hardened on the nozzles of the ink cartridges 15 and 16.

A waste ink collecting box 22 is disposed on the lower plate 21 at a position under the service area. The waste ink collecting box 22 serves to collect waste ink that is discharged just before a printing process so as to supply superior ink by removing hardened ink from the nozzles of the ink cartridges 15 and 16. Therefore, the waste ink that is discharged from the ink cartridges 15 and 16 is collected in the ink collecting box 22. As shown in the drawing, the ink collecting box 22 is in the form of a box open at its top and integrated with the bottom plate 21.

Meanwhile, of the waste ink that is collected in the waste ink collecting box 22 of the conventional ink-jet printer, waste black ink collected from the black ink cartridge 16 experiences a phase change from a liquid phase to a gel phase while being exposed to the atmosphere. Consequently, the waste black ink collected in the waste ink collecting box 22 is not spread uniformly on the bottom of the ink collecting box 22, but is heaped toward the nozzles of the ink cartridges 15 and 16. In this case, since the heaped waste ink comes into contact with the nozzles of the cartridges 15 and 16, the nozzles of the ink cartridges 15 and 16 are contaminated or stopped up by the waste ink, thereby hindering the printing operation of the printer.

Figure 2:
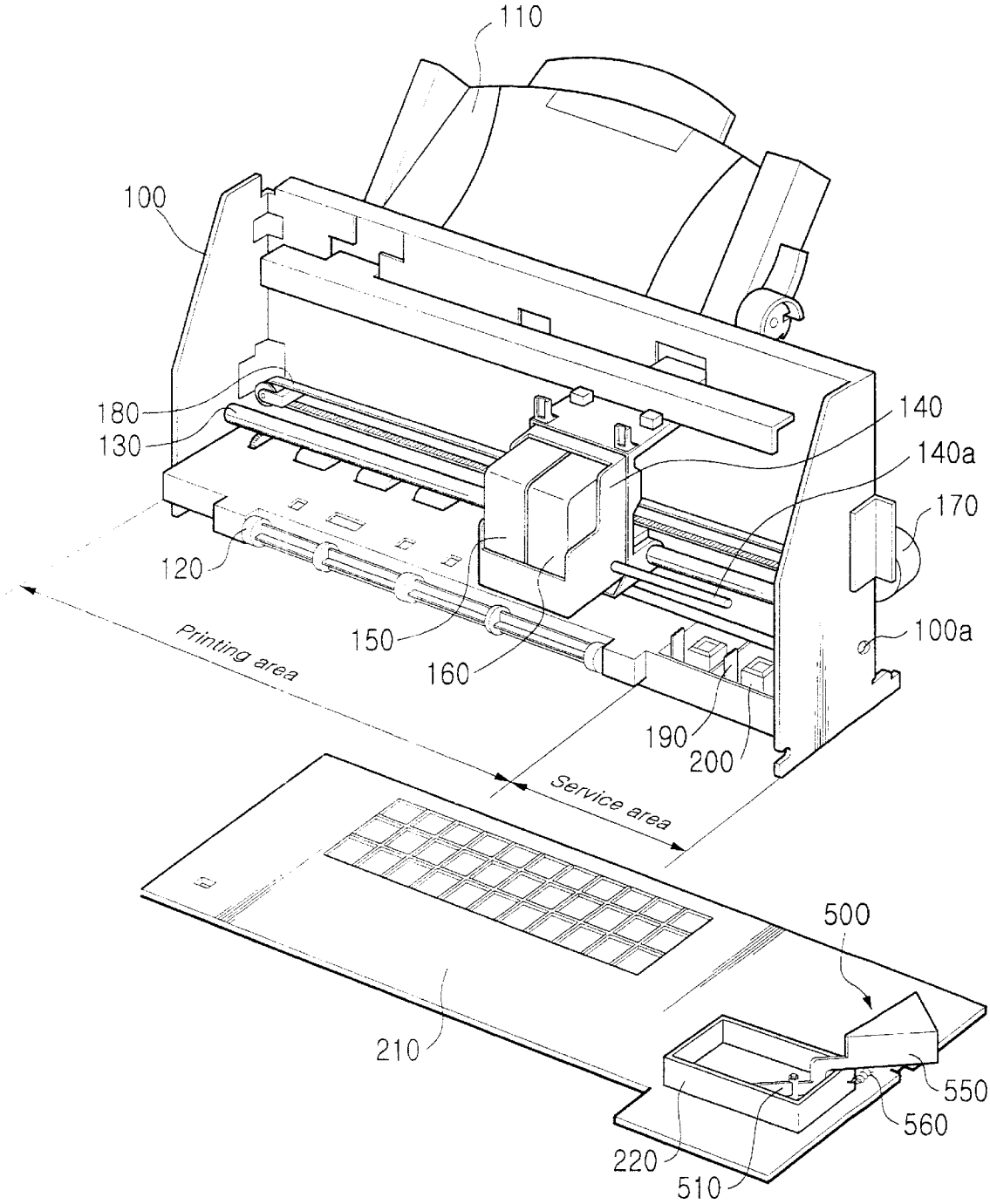
FIG. 2 is a perspective view of an ink-jet printer in accordance with the present invention.

As illustrated in FIG. 2, an ink-jet printer of the present invention has a frame 100 to which the components, described below, are mounted and a lower plate 210 that is secured to the bottom of the frame 100. Although not shown, a case may be placed on the frame 100. A paper feeder 110 is mounted to the rear portion of the frame 100 so as to supply printing paper, and a discharge roller 120 is mounted to the front portion of the frame 100 so as to discharge printed papers. A printing unit is mounted in the frame 100. The printing unit has a guide rod 130 that is horizontally mounted to the frame 100, a carriage 140 that is slidably fitted around the guide rod 130, and a color ink cartridge 150 and a black ink cartridge 160 that are loaded on the carriage 140.

A driving device (reference numeral not assigned) is provided so as to forcibly move the carriage 140 transversely. The driving device has a drive motor 170 that is mounted to one side of the rear portion of the frame 100. A drive belt 180, driven by the drive motor 170, is securely connected to the rear portion of the carriage 140 and uniformly spaced apart from the guide rod 130.

The interior area of the frame 100 may be divided into a printing area and a service area. The printing area is where the carriage 140 is moved transversely while actual printing is performed and the service area is where the carriage 14 is retreated while actual printing is not performed. In particular, wipers 190 and sealing caps 200 are mounted in the service area of the frame 10. The wipers 190 serve to remove remaining ink and dirt that adhere to the nozzles of the ink cartridges 150 and 160, and the sealing caps 200 serve to enclose the nozzles of the ink cartridges 150 and 160 and prevent ink from being hardened on the nozzles of the ink cartridges 150 and 160.

A waste ink collecting box 220 is disposed on and integrated with the bottom plate 210 in the form of a rectangular plate at a position under the service area. In accordance with the present invention, a waste ink spreader 500 is mounted to the waste ink collecting box 220 so as to uniformly spread heaped waste ink that is discharged from the nozzles of the black ink cartridge 160, in the waste ink collecting box 220.

The capacity of the waste ink collecting box 220 for containing waste ink is designed to coincide with the amount of waste ink that is generated during the life span of the ink-jet printer. If waste ink is not spread uniformly in the waste ink collecting box 220, the heaped waste ink comes into contact with the nozzles of the ink cartridges 150 and 160 and overflows the waste ink collecting box 220, after a lapse of a certain time period and before the termination of the life span of the ink-jet printer.

In the case of color ink, the heaping of waste ink does not occur because the waste color ink is low in its viscosity. However, in the case of black ink, the heaping of waste ink occurs because the waste black ink is high in its viscosity and easily hardened in the atmosphere.

The waste ink spreader 500 prevents waste ink from accumulating by being situated directly under the ink-discharged portion of the waste ink collecting box 220 and uniformly spreading the waste ink in the waste ink collecting box 220.

Figure 3:
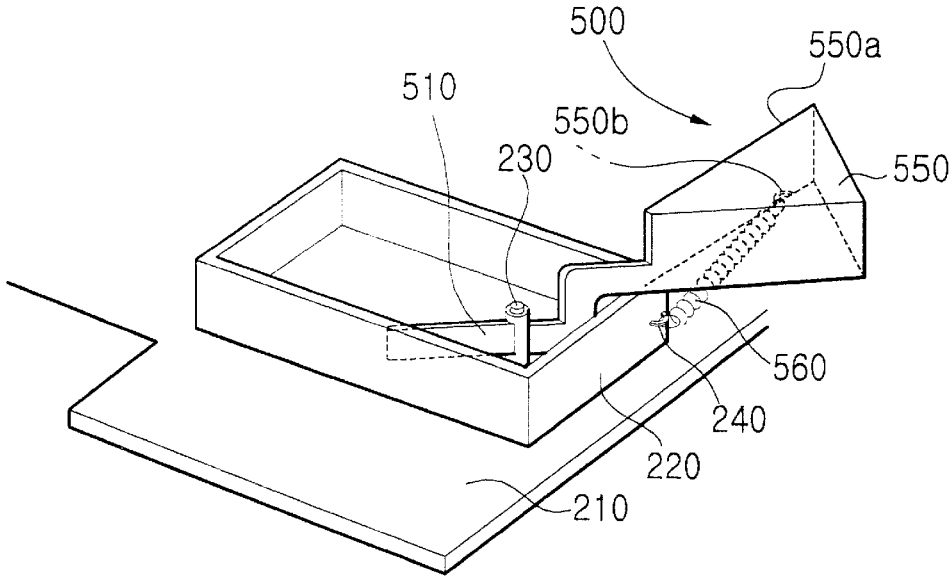
FIG. 3 is a perspective view showing a waste ink collecting box and waste ink spreading device that are combined with each other.
Figure 4:
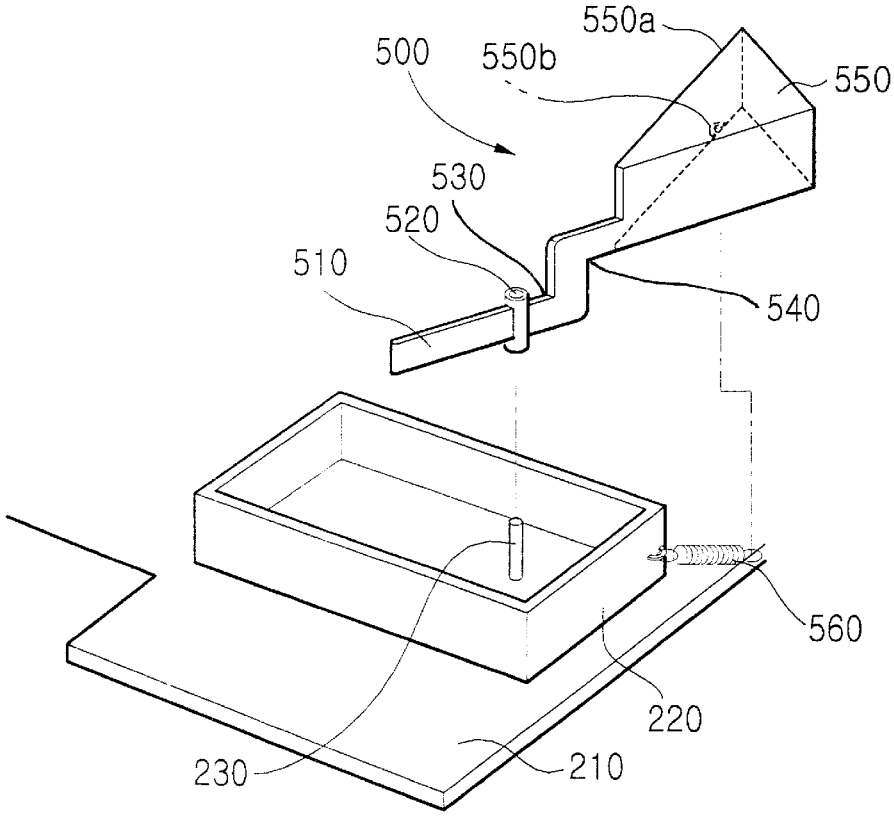
FIG. 4 is an exploded view showing the waste ink collecting box and the waste ink spreading device that are separated from each other.

Referring to FIGS. 3 and 4, a pivot 230 is vertically formed on the bottom portion of the waste ink collecting box 220 at a position where the waste black ink is discharged from the black ink cartridge 160. The waste ink spreader 500 has a rotating sleeve 520 that is rotatably fitted around the pivot 230, a spreader arm 510 horizontally extended from one side of the sidewall of the rotating sleeve 520, a gooseneck portion 530 and 540 that is horizontally extended from the opposite side of the sidewall of the rotating sleeve 520, and a spreader head 550 that is integrated with the outer end of the gooseneck portion 530. The spreader arm 510 is in the form of a plate and extended from the pivot 230 to a certain extent.

The gooseneck portion 530 and 540 is bent two times. The first bend 530 is horizontally extended along the bottom of the waste collecting box 220 and bent upward, and the second bend 540 is vertically extended from the first bend 530 along the wall of the waste collecting box 220 and bent sideward.

The spreader head 550 is in the form of a short right-triangular prism, and is extended from the outer end of the gooseneck portion 540 with its oblique surface 550*a* forming its inside wall. The oblique surface 550*a* of the spreader head 550 is arranged to form a certain angle with the pusher 140*a* so that the pusher 140*a* can be slid upon the oblique surface 550*a*. The height of the spreader head 550 is designed to correspond with the height of the carriage 140.

Two spring hooks 240 and 550*b* are respectively mounted to the sidewall of the waste ink collecting box 220 and the lower edge of the oblique surface 550*a* of the spreader head 550. A spring 560 is caught on the spring hooks 240 and 550*b* at its ends.

Meanwhile, referring to FIG. 2, a pusher 140*a* is horizontally projected from the service area side of the carriage 140 so as to rotate the spreader head 550. A pusher hole 100*a* is formed on a sidewall of the frame 100 so that the pusher 140*a* passes through the pusher hole 100*a* and pushes the spreader head 550. The spreader head 550 has an oblique surface that is arranged to form a certain angle with the pusher 140*a*.

The operation of the printer of the present invention is described hereinafter with an emphasis laid on the operation of the waste ink spreading device.

After a sheet of paper is fed by the paper feeder 10 into the printing area, a printing process is performed while the drive motor 170 moves the carriage 140 transversely. Before actual printing is initiated, the carriage 140 is situated in the service area and the nozzles of the ink cartridges 150 and 160 are enclosed with the sealing caps 200.

Just before actual printing is initiated, the nozzles of the cartridges 150 and 160 are removed from the sealing caps 200 and a small amount of ink is discharged from the ink cartridges 150 and 160 into the ink collecting box 220. As described above, this is for achieving a high quality of printing by discharging hardened ink in the outlets of the nozzles in advance of performing actual printing.

After the advanced discharge of the ink is performned, the carriage 140 performs actual printing while being moved transversely and the nozzles of the ink cartridges 150 and 160 are swept by the wipers 190.

Hereinafter, the operation of the waste ink spreading device is described.

Figure 5A:
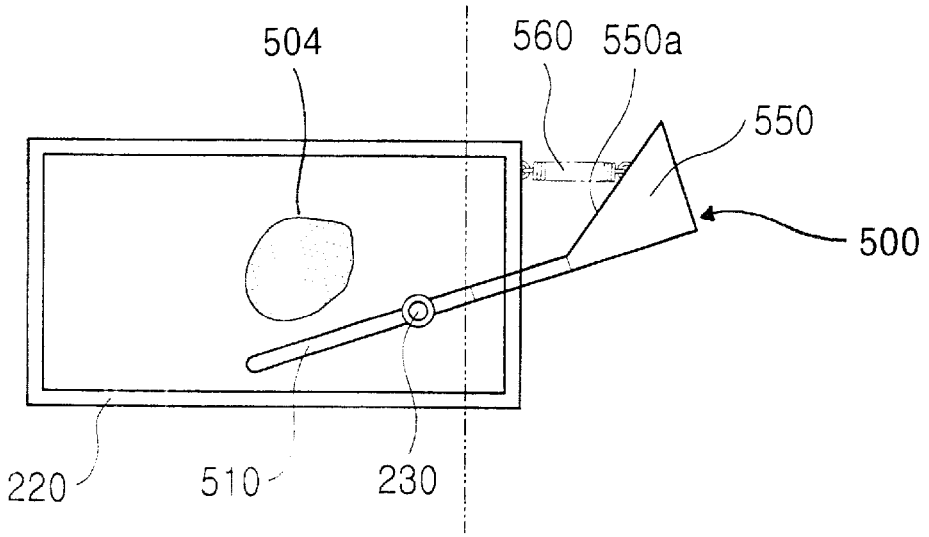
FIGS. 5A to 5C are plan views showing the operation of the waste ink spreading device.

FIG. 5A is a plan view showing the state of the waste ink spreader 500 while the actual printing is performed. In this state, the front end of the spreader arm 510 is situated in the vicinity of the front wall of the waste ink collecting box 220.

Figure 5B:
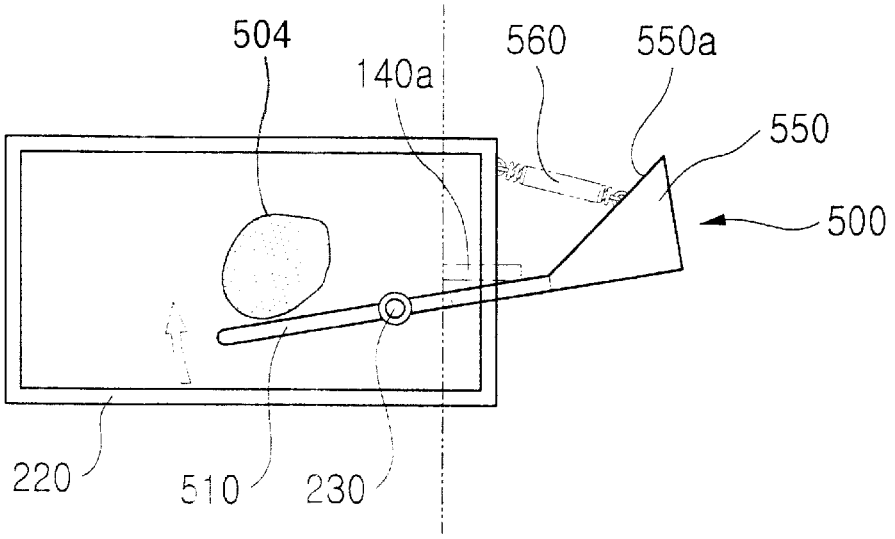
Figure 5C:
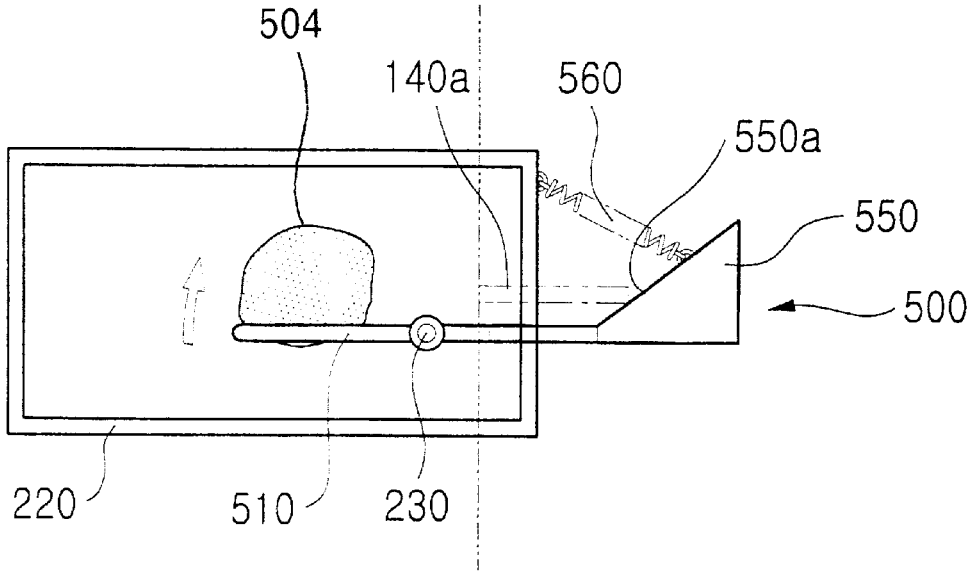

As shown in FIGS. 5B and 5C, when the carriage 140 is returned to the service area after actual printing, the pusher 140a projected from the carriage 140 pushes the oblique surface 550*a* of the waste ink spreader 550. As a result, as the force exerted by the pusher 140*a* overcomes the force of the spring 560, the spreader arm 510 and the spreader head 550 are rotated around the pivot 230 clockwise. In this state. the front end of the spreader arm 510 is situated in the vicinity of the rear wall of the waste ink collecting box 220.

When the carriage 140 is moved to the printing area for new actual printing, a small amount of ink is discharged from the nozzles of the ink cartridges 150 and 160 just before the actual printing. In the meantime, as the carriage 140 is moved to the printing area, the spreader arm 510 and the spreader head 550 are rotated around the pivot 230 counterclockwise by the restoring force of the spring 560. During the counterclockwise rotation of the spreader arm 510, heaped waste ink 504 is spread uniformly in the waste ink collecting box 220 by the spreader arm 510. Finally, the waste ink spreader 500 is situated as shown in FIG. 5A.

As described above, the present invention provides an ink-jet printer that is capable of uniformly spreading the heaped waste ink in its waste ink collecting box, thereby preventing the nozzles of its ink cartridges from being contaminated or stopped up and preventing waste ink from overflowing the waste ink collecting box due to the heaping of the waste ink.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ink-jet printer, comprising:

a frame having on one side a paper feeder mounted and on the other side a discharge device mounted;

a carriage being mounted on said frame and having an ink cartridge loaded, said carriage being transversely reciprocated between a printing area and a service area along a guide rod that is horizontally mounted to said frame, said service area being an area where said carriage is retreated while printing is not performed;

a box collecting waste ink discharged from said ink cartridge in the service area; and an ink spreading unit uniformly spreading the waste ink heaped in said box.

2. The printer of claim 1, with said ink spreading unit comprising:

a hinge portion rotatably mounted to said box;

an arm extended from one side of said hinge portion, said arm uniformly spreading heaped waste ink in said waste ink collecting box; and a head extended from an opposite end of said hinge portion, said arm rotating by an actuation of said head.

3. The printer of claim 2, with said ink spreading unit further comprising a spring secured from an end of said box to an end of said head of said ink spreading unit.

4. The printer of claim 2, with said head being actuated by a movement of said carriage.

5. The printer of claim 2, with said ink spreading unit further comprising a protrusion projecting from a side of said carriage facing the service area, said protrusion actuating said head to rotate said waste ink spreader.

6. The printer of claim 5, with said head having an oblique surface being arranged to form a certain angle with said protrusion.

7. The printer of claim 2, with said hinge portion being a rotating sleeve fitted around a pivot pin mounted on a bottom portion of said box.

8. The printer of claim 7, with said hinge portion mounted on a location of the bottom portion receiving a discharge from the ink cartridge, said ink cartridge having a black color.

9. The printer of claim 2, with said head connected to said hinge portion through a neck, the neck having a first and second horizontal section connected by a vertical section, the first horizontal section extending from said hinge portion and being bent into the vertical section, the vertical section bent to form the second horizontal section, the second horizontal section coupled to said head, the neck accommodating said head to protrude out of said box and the arm to be adjacent to the bottom of said box.

10. The printer of claim 2, with said head connected to said hinge portion by a neck, the neck accommodating said head to protrude out of said box and the arm to be adjacent to the bottom of said box.

11. The printer of claim 2, with the neck having a first horizontal section extended along the bottom of said box and bent upwards into a vertical section extended along a side wall of said box, said vertical section bent into a second horizontal section connecting to said head, said head and said second horizontal section being above the side wall of said box.

12. The printer of claim 11, with said head having a right-triangular prism shape, a vertex of said head coupled to said neck, a flat side of said head being normal to the bottom surface of said box, said head having an oblique side connecting the flat side with the vertex, the oblique side having a surface normal to the bottom of said box.

13. The printer of claim 12, with said oblique side of said head being arranged to form a predetermined angle with said protrusion, the predetermined angle accommodating said protrusion to slide upon said oblique side.

14. The printer of claim 2, with said arm being a plate normal to a bottom surface of said box.

15. The printer of claim 2, with said head having a height corresponding to a height of said carriage.

16. An ink-jet printer, comprising:

a frame having on one side a paper feeder mounted and on the other side a discharge device mounted;

a carriage being mounted on said frame and having an ink cartridge loaded, said carriage being transversely reciprocated between a printing area and a service area along a guide rod that is horizontally mounted to said frame;

a box mounted on said carriage collecting waste ink discharged from said ink cartridge in the service area, said box having an opening on a top side; and an ink spreading unit having a hinge portion rotatably mounted to said box, said ink spreading unit having an arm extending from one side of the hinge portion and a head extending from another side, said arm uniformly distributing heaped waste ink in said box, said ink spreading unit rotatably mounted, said head extended from an opposite end of said hinge portion, an actuation of said head rotating said arm.

17. The printer according to claim 16, with said ink spreading unit further comprising, a spring secured to an end of said box and an end of said head of the ink spreading unit; and a protrusion projecting from a side of said carriage facing the service area, said protrusion pushing said head to actuate said ink spreading unit to distribute waste ink in said box.

18. The printer of claim 17, with said ink spreading unit further comprising a spring secured from an end of said box to an end of said head of said ink spreading unit.

19. The printer of claim 18, with said head being actuated by a movement of said carriage.

20. The printer of claim 19, with said ink spreading unit further comprising a protrusion projecting from a side of said carriage facing the service area, said protrusion actuating said head to rotate said waste ink spreader.

21. The printer of claim 20, with said head having an oblique surface being arranged to form a certain angle with said protrusion.

22. The printer of claim 21, with said hinge portion being a rotating sleeve fitted around a pivot pin mounted on a bottom portion of said box.

23. The printer of claim 22, with said hinge portion mounted on a location of the bottom portion receiving a discharge from the ink cartridge.

24. The printer of claim 23, with said head connected to said hinge portion through a neck , the neck having a first and second horizontal section connected by a vertical section, the first horizontal section extending from said hinge portion and being bent into the vertical section, the vertical section bent to form the second horizontal section, the second horizontal section coupled to said head, the neck accommodating said head to protrude out of said box and the arm to be adjacent to the bottom of said box.

25. The printer of claim 24, with said head having a right-triangular prism shape, a vertex of said head coupled to said neck, a flat side of said head being normal to the bottom surface of said box, said head having an oblique side connecting the flat side with the vertex, the oblique side having a surface normal to the bottom of said box.

26. The printer of claim 25, with said oblique side of said head being arranged to form a predetermined angle with said protrusion, the predetermined angle accommodating said protrusion to slide upon said oblique side.

27. The printer of claim 26, with said arm being a plate normal to a bottom surface of said box.

28. The printer of claim 27, with said head having a height corresponding to a height of said carriage.

29. A method, comprising the steps of:

feeding a printable medium into a printing area of a printer by a feeding unit;

stationing a carriage in a service area with a nozzle of an ink cartridge being enclosed with a sealing cap, said ink cartridge inserted into said carriage;

removing said sealing caps from said nozzle, said nozzles discharging ink from said ink cartridge into an open box mounted on said printer;

executing a printing process while a drive motor moves said carriage transversely;

wiping said nozzles while executing the printing process, the ink being deposited into said box; and actuating an ink spreading unit by a protrusion formed from said carriage being in contact with a head portion of said ink spreading unit, said ink spreading unit formed on said box and having an arm and said head, said arm uniformly spreading the ink deposited from the nozzle into said box.

30. The method of claim 29, with said step of actuating an ink spreading unit further comprising the steps of:

rotating in a forward direction said ink spreading unit about a pivot portion when said carriage enters from the printing area toward the service area; and rotating in a reverse direction said ink spreading unit about the pivot portion when said carriage moves from the service area to the printing area.

31. The method of claim 30, with said step of rotating in the reverse direction through a force generated by a spring attached from said head to said box.

* * * * *